United States Patent [19]

Fitzgerald

[11] 4,193,177

[45] Mar. 18, 1980

[54] ELECTRICAL CONNECTOR ASSEMBLY APPARATUS

[75] Inventor: John D. Fitzgerald, Columbus, Ohio

[73] Assignee: Bell Telephone Laboratories, Incorporated, Murray Hill, N.J.

[21] Appl. No.: 961,712

[22] Filed: Nov. 17, 1978

[51] Int. Cl.[2] ..... H01R 43/04

[52] U.S. Cl. ..... 29/56.6; 29/566.3

[58] Field of Search ..... 29/33 M, 56.6, 566.3, 29/564.6, 749, 760, 629; 72/24

[56] References Cited

U.S. PATENT DOCUMENTS

| | | | |
|---|---|---|---|
| 3,293,730 | 12/1966 | Klotz | 29/629 |
| 3,769,823 | 11/1973 | Greeninger | 72/24 |
| 3,810,289 | 5/1974 | Hannaberry | 29/56.6 |
| 3,845,535 | 11/1974 | Over | 29/56.6 |
| 3,953,916 | 5/1976 | Rolland | 29/566.3 |
| 3,972,101 | 8/1976 | Casey et al. | 29/564.6 X |
| 4,001,931 | 1/1977 | McKee | 29/564.6 X |
| 4,035,897 | 7/1977 | Over et al. | 29/56.6 |
| 4,066,316 | 1/1978 | Rollings | 339/91 |

*Primary Examiner*—William R. Briggs

*Attorney, Agent, or Firm*—William H. Kamstra

[57] ABSTRACT

Apparatus for assembling an electrical connector housing (15) and a conductor mounting comb (41) comprising a pair of clamping mechanisms (14, 27) for clasping the housing (15) and comb (41) which mechanisms are brought together by a press (10) to force the housing (15) about the prewired comb (41). The conductors (52) are arranged in the comb (41) which in turn is supported between two fixed jaws (28, 29) of a lower clamping mechanism (27), the conductors (52) being arranged in slots (54) of one jaw (28). The housing (15) is clasped between two jaws (16, 17) of an upper clamping mechanism (14), one of which terminates in a blade (21), the blade (21) rising to a conductor folding ramp (22). As the press is operated, the upper mechanism (14) moves downward, the blade (21) cooperating with a second blade (33) on a lower jaw (28) to trim the conductor (52) ends. The latter ends are folded about the comb (41) by the ramp (22) as the downward movement continues, which movement is completed as the conductors (52) make electrical contact with corresponding insulation piercing terminals retained by the housing (15).

5 Claims, 9 Drawing Figures

ELECTRICAL CONNECTOR ASSEMBLY APPARATUS

TECHNICAL FIELD

This invention relates to electrical connector arrangements and particularly to apparatus for assembling the components of such connector arrangements.

BACKGROUND OF THE INVENTION

Although the physical design of communications and electronics systems has in recent years seen extensive advances in terms of simplification, miniaturization, circuit integration, and the like, the interconnection between system components and mounting frames still relies largely on individual conductors assembled in cables for power distribution and signal transmission. In many systems, terminations from the many circuit units are collected at common points where terminals are provided to which individual cable conductors must be joined. Although the art has offered improvements in terminating arrangements, problems of facilitating and speeding the individual joining of conductors and terminals remain. Both soldered and solderless connections have been extensively employed in the past, in the latter group appearing the well-known insulating piercing terminals. Electrical connection between such terminals and the cable conductors is achieved by slicing through the conductor insulation by means of bifurcated blades extending from the terminals, which blades at the same time seize the bared conductors to make the connections. This method has the obvious advantage that, not only is the tedious and time-consuming soldering step eliminated, but the necessity of first stripping the conductor insulation is also avoided.

Conventionally, the individual cable conductors are first sorted and arranged on a first insulating member mounting the conductors in a pattern corresponding to the spacings of terminal blades retained in a second insulated housing member. The two members are adapted to be fitted one to the other during which assembly the blades function as described to make the electrical connections. A unitary connector assembly is thus realized which may be readily separated to permit wiring changes and repair of the connections. One known connector assembly of this character is disclosed, for example, in U.S. Pat. No. 4,066,316 of R. W. Rollings issued Jan. 3, 1978. As there demonstrated, the two parts of the connector are precisely dimensioned to ensure accurate alignment of conductors and bladed terminals and also to ensure that the two parts are firmly fitted together to prevent separation of the electrical connections. As a result, the assembly of the connector involves a number of operative steps, each of which must be carefully attended to in order to achieve reliable connector service. Thus, for example, means must be provided to retain the conductor mounting member so that the individual cable conductors may be properly sorted and arranged thereon with minimum effort. After the loading of the mounting member, it must then be precisely aligned with the contact terminal housing to ensure that the insulation piercing terminals retained by the latter member make accurate contact with the corresponding cable conductors to prevent bending and distortion of the parts. Means must also be provided for trimming access conductor lengths in view of the close fitting of the terminal housing. Finally, sufficient force must be evenly applied to one of the connector members to establish the simultaneous electrical connections of what may be a relatively large number of terminals and conductors. These operations may also be aggravated when they must be performed during field maintenance, for example. It is the facilitation of these operations and attendant problems that the connector assembly apparatus of this invention is chiefly directed.

Apparatus for performing one or more operations broadly analogous to the examples mentioned in the foregoing is known in the art. U.S. Pat. No. 4,035,897, of W. R. Over et al., issued July 19, 1977, for example, discloses a press arrangement for connecting conductors to contact terminals of an electrical connector albeit of a character dissimilar from the connector arrangement contemplated in the foregoing.

SUMMARY OF THE INVENTION

The assembly of a contact terminal housing mounting a plurality of insulation piercing terminals and a conductor retaining member or comb is simplified and facilitated in the use of assembly apparatus according to this invention in which a pair of vertically arranged, opposing clamping means retain the housing and comb, respectively, in alignment. The lower clamping means is mounted on the platform of a manually operated press and is pivotable outwardly to facilitate the sorting and arranging of the cable conductors in the comb retained thereby. The terminal housing is clasped between jaws of the upper clamping means which is mounted at the end of the ram of the press. One jaw of the upper clamping means as well as one jaw of the lower clamping means terminates in a conductor shearing blade for trimming the cable conductors to suitable lengths. After the cable conductors have been properly arranged in the connector comb, the lower retaining clamp means is pivoted into alignment with the upper clamp and its clasped housing preparatory to the assembly operation.

The press apparatus is manually operated to move the ram downwardly by well-known rack and pinion operation to fit the terminal housing about the conductor retaining comb. In doing so, the aforementioned upper jaw blade in cooperation with the lower jaw blade trims the cable conductors to suitable uniform lengths. The same upper jaw is provided with a ramp rising from the blade edge, which ramp folds the conductor ends at right angles about the comb as the ram continues its downward movement. This movement is completed as the conductors are forced between the corresponding insulation piercing blades of the terminals retained in the housing to establish the electrical connections. At this point the terminal housing is locked in position about the conductor comb by latching means provided on these members and the unitary connector thus formed may be removed from the press.

BRIEF DESCRIPTION OF THE DRAWING

The features and advantages of a connector assembly apparatus according to the principles of this invention will be better understood from a consideration of the detailed description of the organization and operation of one illustrative embodiment thereof which follows when taken in conjunction with the accompanying drawing in which.

DETAILED DESCRIPTION

An exemplary electrical connector arrangement which may advantageously be assembled by an assembly apparatus according to this invention is described in detail in the afore-cited patent of R. W. Rollings and comprises, as one part, a rectangular, insulated housing in which a plurality of contact terminals are arranged side-by-side in two rows in slotted apertures provided therefor. At one end, the terminals appear at one face of the housing and there provide sockets to receive backplane or other terminal pins. At their other ends, the terminals are provided with bifurcated blades which lie on opposite sides of a shelf dividing a cavity in the housing. The blades protrude from the shelf edge for at least the length of the blade bifurcations. The second part of the connector comprises an insulated comb adapted to be fitted into the cavity of the housing and is provided with a plurality of fingers, the spacings between which correspond to the spacings between the housing contact terminal blades. Preparatory to the assembly of the two connector parts, individual conductors of a cable are sorted and arranged between adjacent ones of the comb fingers. The conductors are maintained in grooves along the face of the comb and lie in corresponding grooves along the sides of the comb to permit a snug fit within the housing cavity. The two-part connector is assembled by the force-fitting of the conductor retaining comb into the open face of the terminal housing. During this mating operation, the bifurcated blades of the contact terminals seize corresponding conductors presented between the comb fingers and slice through the conductor insulation and into the underlying metal to make the electrical connections. As the comb is forced into the housing cavity, it is securely locked in place by the engagement of pawls formed at the ends of particular comb fingers and detent lips of slots provided in opposite walls of the housing.

Figure 1:
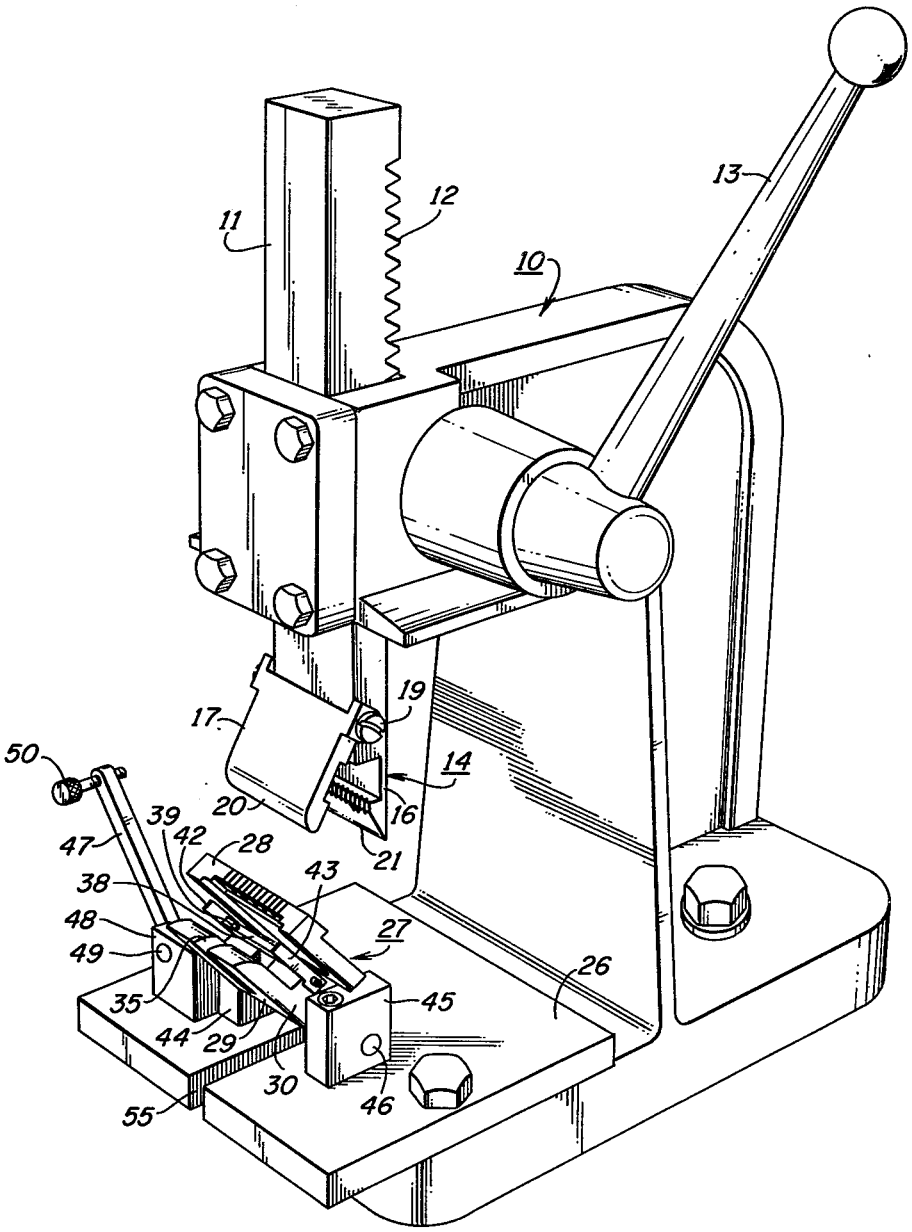
FIG. 1 depicts in perspective view an illustrative connector assembly apparatus showing the operative mechanisms in positions preparatory to the loading of the connector parts.

The foregoing general description of a connector arrangement of the character contemplated herein is sufficient for a complete understanding of the assembly apparatus of this invention. Accordingly, its details will be referred to hereinafter only to the extent necessary to understand the organization and operation of the assembly apparatus, the details of which may now be considered. In FIG. 1 an exemplary assembly apparatus is depicted in perspective view, the operative assembly mechanisms being shown in their positions preparatory to the loading of the connector parts and cable conductors. These mechanisms, to be described, are mounted in association with a bench press 10 of a character well-known in the art having a ram 11 adapted for vertical reciprocal movement by means of a rack 12 and pinion (not visible in the figure) in turn manually operable by an arm 13. Bench press 10 is adapted to be permanently bolted to a supporting surface as shown or it may remain portable if intended for field maintenance, for example.

Figure 2:
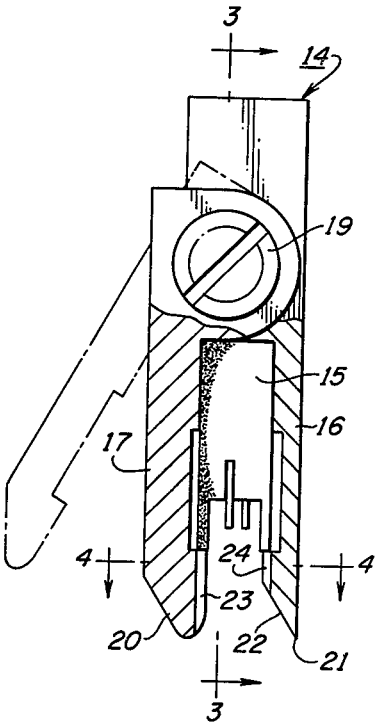
FIG. 2 is an end, partially sectioned and enlarged view of one clamping mechanism of the assembly apparatus of FIG. 1.
Figure 3:
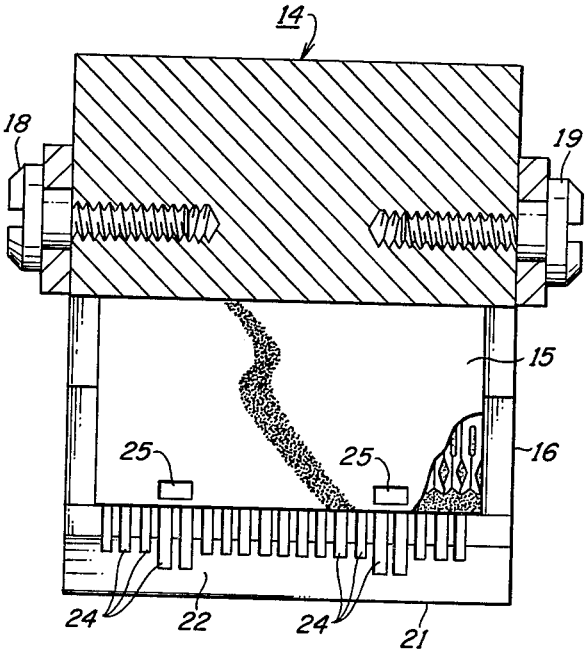
FIG. 3 is an enlarged sectional view of the mechanism of FIG. 2 taken along the line 3—3.
Figure 4:
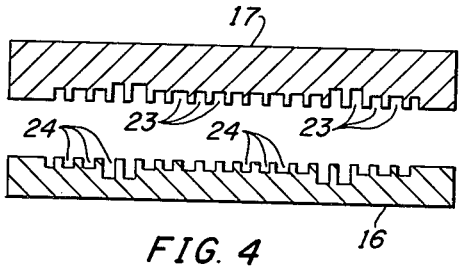
FIG. 4 is a sectional view of the mechanism of FIG. 2 taken along the line 4—4.

A first of the operative mechanisms is affixed to the end of ram 11 and comprises an upper clamp 14 for clasping and retaining the connector terminal housing 15 shown in place in the section views of FIGS. 2 through 4, to which figures reference may now also be had. Clamp 14 comprises a pair of jaws 16 and 17 between which housing 15 is retained. Jaw 17 is pivotable outward, as represented in broken-line outline in FIG. 2, about a pair of pintle screws 18 and 19 set in the base of clamp 14 to facilitate loading of the connector housing as shown in FIGS. 1 and 2. The end of jaw 17 is slightly rounded and is provided with a transverse ramp 20 for purposes which will become clear hereinafter. Fixed jaw 16 terminates in a blade 21 and a ramp 22 rising from the blade edge. These details are more clearly shown in the section views of FIGS. 2 and 3 where the configuration of the inner faces of jaws 16 and 17 are also shown. The latter faces are provided with opposing sets of grooves or slots 23 and 24 (FIG. 4) corresponding to the grooves of the connector comb mentioned in connection with the description of the connector parts in the foregoing. As shown in FIGS. 3 and 4, a number of the slots 23 and 24 are somewhat deeper than the others to admit the latching pawls of the comb which engage the detent lips of slots 25 provided in the side walls of housing 15. The inner faces of jaws 16 and 17 are configured as described to admit the specific illustrative connector housing described hereinbefore and it will be appreciated that the face surfaces may be modified to correspond to other and different connector members to be assembled.

Figure 5:
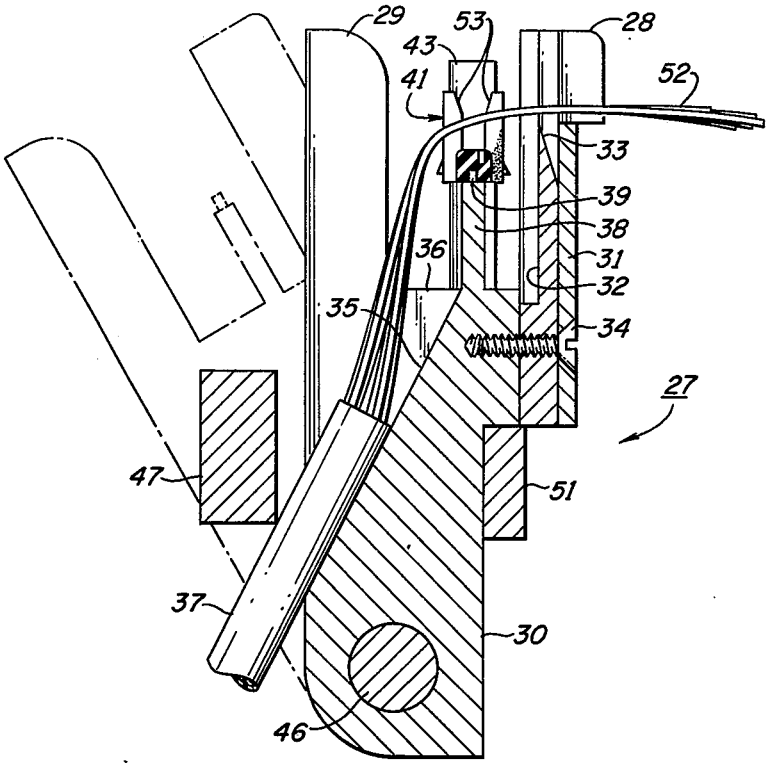
FIG. 5 is an enlarged sectional side view of a second clamping mechanism of the assembly apparatus of FIG. 1 showing the manner in which an electrical cable is retained thereby.

The second operative mechanism of an assembly apparatus according to this invention is affixed to a platform 26 mounted on the base of press 10 and comprises a lower clamp 27. Clamp 27 comprises a pair of fixed jaws 28 and 29 extending upwardly from a base 30 (FIGS. 1 and 5). As more clearly shown in FIG. 5, jaw 28 is formed in two parts: a conductor sorting backplate 31 and a blade 32 fitted in a channel in backplate 31, blade 32 having a cutting edge 33 near the upper end of jaw 28. The two parts of jaw 28 are affixed to base 30 in any convenient manner such as by screws, one of which, screw 34, is shown in FIG. 5. The other fixed jaw 29 is formed to present a central slot 35, the base of which is sloped upwardly from the outer face and lower end of clamp 27 to the floor 36 of the slot formed between jaws 28 and 29. Slot 35 is dimensioned to just admit the diameter of the cable 37 to be terminated by the connector assembly, which cable 37 is shown in place in the views of FIGS. 5 and 6. The inner top edge of jaw 29 is rounded to facilitate its meeting with ramp 20 of jaw 17 of the upper clamp 14 during operation of the apparatus to be described. Extending upwardly from floor 36 between jaws 28 and 29 is a pedestal 38 having a pair of locating pins 39 and 40 on its upper surface for accurately locating a connector comb 41 shown in section view and in place in FIG. 5. End guides 42 and 43 are affixed at the ends of pedestal 38, which guides act as additional locating means for comb 41. (See also FIG. 6). Clamp 27 is pivotally mounted on platform 26 between a pair of uprights 44 and 45 affixed thereto by means of a pin 46 extending through the latter uprights and base 30 of clamp 27.

Figure 6:
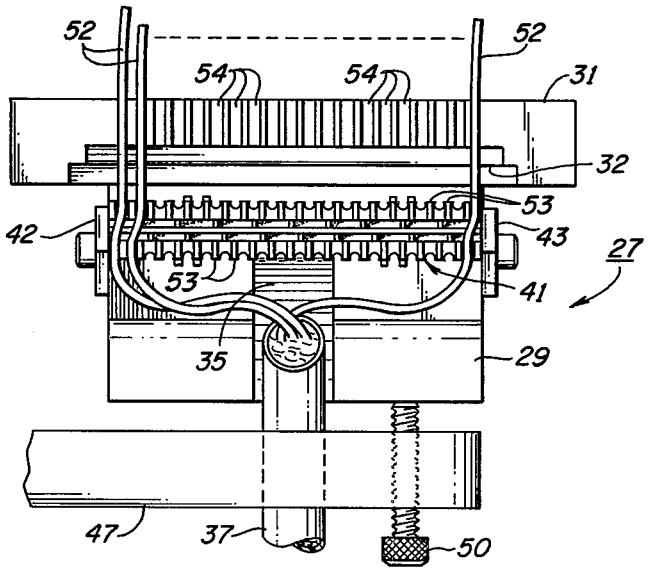
FIG. 6 is a top view of the clamping mechanism of FIG. 5 also showing the disposition of a retained cable.
Figure 7:
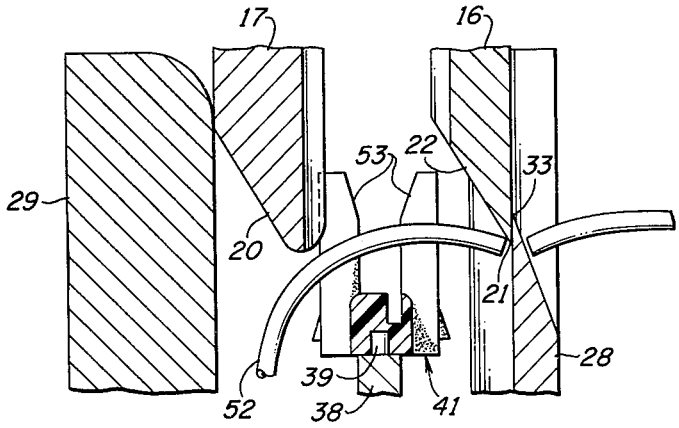
FIG. 7 is an enlarged, sectional view of a portion of the assembly apparatus of the preceding figures during one step in the assembly operation.
Figure 8:
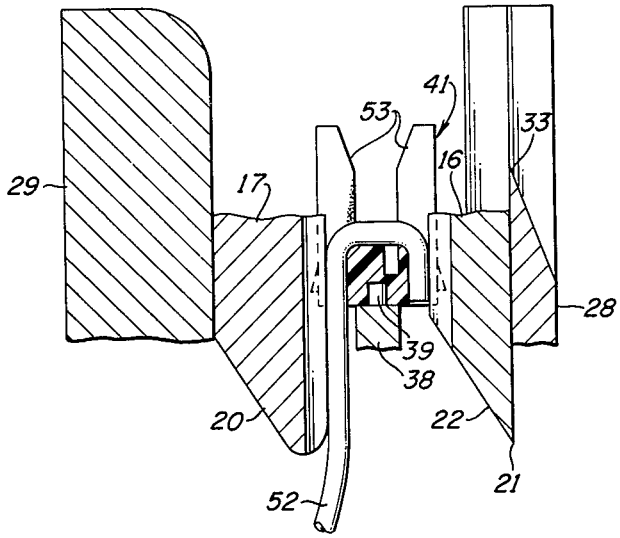
FIG. 8 is an enlarged, sectional view of the same portion of the assembly apparatus as depicted in FIG. 7 during a succeeding step in the assembly operation.

Clamp 27, as previously mentioned and as represented in broken-line outline in FIG. 5, is shown in FIG. 1 as thus pivoted outwardly from the perpendicular to facilitate the loading of the electrical cable and its conductors. In FIG. 6 clamp 27 is shown in its operative perpendicular position preparatory to the operation of press 10. In order to secure clamp 27 in this position during operation of press 10, a locking arm 47 is provided which is pivotally mounted at one end on platform 26 by means of an upright 48 affixed thereto and a pin 49 extending through the latter upright and the end of arm 47. With clamp 27 in its perpendicular position, locking arm 47 is pivoted in a clockwise direction across the outer face of jaw 29 (FIGS. 5 and 6) in which position a set screw 50 at the other end of arm 47 is manually turned to seat against the outer face of jaw 29 to abut and hold clamp 27 firmly against a backstop plate 51 which will be understood as extending between uprights 44 and 45 (FIG. 5). Other details of the construction of the assembly apparatus of the invention will be described in connection with the description of an illustrative operation thereof which may now be considered with particular reference to FIGS. 7 through 9.

Initially, the assembly apparatus is in the state as that depicted in FIG. 1, that is, movable upper jaw 17 is open, locking arm 47 is rotated aside, and lower clamp 27 is tilted forward. A contact housing 15 is inserted in the upper clamp 14 and movable jaw 17 is closed. The placement of housing 15 after loading is shown in FIGS. 2 and 3, housing 15 being partially broken away to show representative insulation piercing terminals mounted within. For reasons which will appear hereinafter, no latching or locking mechanism is required for jaw 17, the latter jaw only being required to close properly about one side of housing 15. A connector comb 41 is next placed in position on pedestal 38 between lower jaws 28 and 29. The bared conductors 52 of an electrical cable 37 are now properly fitted between the fingers 53 of comb 41 and are extended also to fit into a plurality of slots 54 corresponding to the spacings between fingers 53, which slots 54 are formed at the upper end of lower jaw 28. Cable 37 lies in slot 35 to which it is made accessible by a corresponding slot 55 formed in press platform 26. With the clamp 27 thus loaded, it is rotated to its perpendicular position and is locked in place by locking arm 47 and its seating set screw 50 in the manner described in the foregoing. Cable 37 and its conductors 52 will now be arranged as shown in FIGS. 5 and 6. The connector parts are now in condition to be mated by the force applied by press ram 11. As arm 13 of press 10 is manually rotated counter-clockwise, ram 11 and its upper clamp 14 move downwardly to urge upper jaws 16 and 17 between lower jaws 28 and 29. A guiding action to prevent collision of the parts is provided by ramp 20 of upper jaw 17 and the rounded upper end of lower jaw 29. This action is depicted in the enlarged sectional view of FIG. 7 at the point where the upper and lower jaws begin their engagement. Fixed lower jaw 29, by its frictional engagement with pivotable upper jaw 17, now also maintains the latter jaw firmly clasped about housing 15. As there shown, at this point also the upper and lower blades 21 and 33 of jaws 16 and 28 cooperate to trim the excess lengths of conductors 52.

Figure 9:
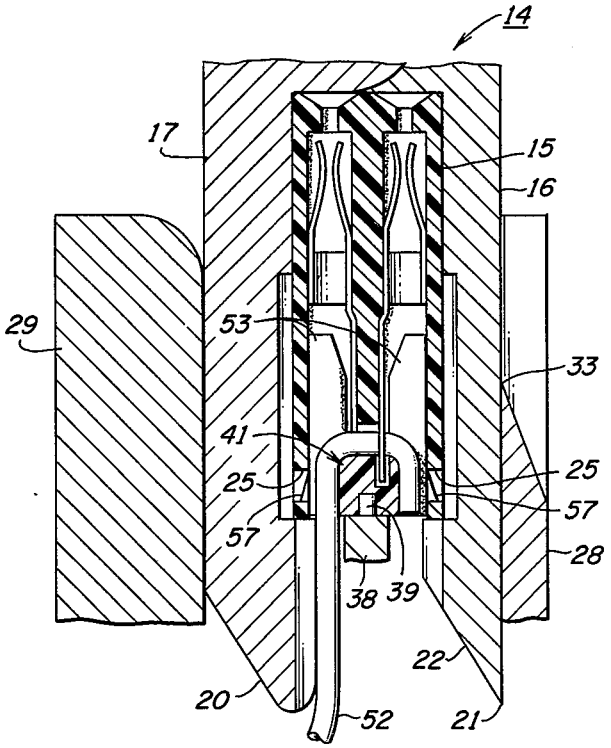
FIG. 9 is an enlarged, sectional view of the same portion of the assembly apparatus as depicted in FIGS. 7 and 8 during a final step in the assembly operation.

As the downward movement of ram 11 and clamp 14 continues, ramp 22 of upper jaw 16 frictionally draws the conductors 52 downward to securely seat the latter between the fingers 53 of comb 41 against the base of the spacings therebetween. Importantly, as ramp 22 passes the conductor ends and as the downward movement continues, the inner faces of jaws 16 and 17 fold the conductors 52 about the sides of comb 41 and securely seat them in the slots provided therefor in those sides. This final arrangement of conductors 52 is shown in the enlarged sectional view of FIG. 8 and thus arranged, the connector parts are now in condition for the final assembly step to achieve a unitary structure as depicted in the enlarged sectional view of FIG. 9. In a final continuation of the downward movement of upper clamp 14, connector housing 15 is fitted about comb 41 at which time the bifurcated blades of the housing terminals pierce the conductor insulation to establish the electrical connections between the terminals and the conductors. A representative final position of a terminal and a conductor is shown in FIG. 9, where a terminal 56 is depicted in contact with a conductor 52. As finally assembled, the two parts of the connector are locked together by pawls 57 extending from particular fingers 53 of comb 41 which pawls engage detent lips of slots 25 provided in the outer walls of connector housing 15. Although not necessary for an understanding of the present invention, FIG. 9 also depicts the two-tier disposition of the contact terminals and the socket receptacles presented thereby in a typical connector arrangement. With the connector assembled as thus described, the upper clamp 14 is withdrawn by reversing the rotation of press arm 13, thereby drawing with it the cable and its now connected conductors. When the upper clamp jaw 17 clears lower clamp jaw 29, it may be rotated outwardly to remove the assembled connector.

What has been described is considered to be only one specific illustrative connector assembly apparatus according to the principles of this invention. Accordingly, it is to be understood that various and numerous other arrangements may be devised by one skilled in the art without departing from the spirit and scope of the invention. Thus, for example, it will be appreciated that, although in the foregoing manually operated apparatus was described, the apparatus may readily be adapted for power operation as dictated in practice by specific fabrication and assembly uses. The invention is thus limited only as defined by the accompanying claims.

I claim:

1. Apparatus for assembling an electrical connector housing (15) having an array of insulation piercing contact terminals and a conductor mounting comb (41) having a corresponding array of insulated electrical conductors (52) arranged therein, said apparatus including a press means (10) having a ram (11) and platform (26) for mounting a first and a second clamping mechanism (14, 27) therebetween for retaining said housing (15) and said comb (41), respectively, in alignment and for fitting said housing (15) about said comb (41), characterized in that said first clamping mechanism (14) is provided with a pair of jaws (16, 17) with means for clasping said housing (15), one of said jaws (16) being terminated in a conductor folding ramp (22) and a first conductor severing blade (21), said second clamping mechanism (27) is provided with a second pair of jaws (28, 29) and a pedestal (38) therebetween for supporting said comb (41), and in that one of said second pair of jaws (28) has a plurality of slots (54) corresponding to said array of conductors (52) for arranging the ends of said conductors (52) therein and is provided with a second conductor severing blade (33), and further in that said first and second blades (21, 33) cooperate to sever said conductors (52) and said ramp (22) is positioned to fold said conductors (52) about said comb (41) as said housing (15) is fitted about said comb (41).

2. Apparatus as claimed in claim 1 further characterized in that one of said jaws (17) of said first clamping mechanism (14) is pivotable outwardly for facilitating the insertion and removal of said housing (15).

3. Apparatus as claimed in claims 1 or 2 further characterized in that said second clamp mechanism (27) is pivotable outwardly from said alignment for facilitating the arrangement of said conductors (52) in said comb (41) and in said slots (54).

4. Apparatus as claimed in claim 3 further characterized in that one of said jaws (29) of said second clamping mechanism (27) is positioned to urge said one of said jaws (17) of said first clamping mechanism (14) against said housing (15) as said housing (15) is fitted about said comb (41).

5. Apparatus as claimed in claim 4 further characterized in that locking means (47, 50) are provided for maintaining said second clamping mechanism (27) in said alignment.

* * * * *